US005979308A

United States Patent [19]

Kägi et al.

[11] Patent Number: 5,979,308

[45] Date of Patent: Nov. 9, 1999

[54] FLAT EMBOSSING MACHINE WITH A FOIL LOOP STORE

[75] Inventors: Beat Kägi, Bichwil; Hanspeter Gietz, Gossau; Manfred Rösli, Herisau, all of Switzerland

[73] Assignee: Maschinenfabrik Geitz AG, Gossau, Switzerland

[21] Appl. No.: 09/021,757

[22] Filed: Feb. 11, 1998

[30] Foreign Application Priority Data

Feb. 13, 1997 [CH] Switzerland ..... 312/97

[51] Int. Cl.[6] ..... B31F 1/07

[52] U.S. Cl. ..... 101/3.1; 101/27

[58] Field of Search ..... 101/3.1, 21, 27, 101/32; 242/419.3

[56] References Cited

U.S. PATENT DOCUMENTS

| | | | |
|---|---|---|---|
| 1,558,156 | 10/1925 | Ford | 101/3.1 |
| 3,584,572 | 6/1971 | Apicella | 101/24 |
| 4,218,026 | 8/1980 | Stange | 242/55 |
| 4,253,597 | 3/1981 | Waffner | 226/40 |
| 4,852,382 | 8/1989 | Gietz et al. | 72/406 |
| 5,448,419 | 9/1995 | Bigelow et al. | 360/17 |
| 5,611,272 | 3/1997 | Steuer | 101/23 |
| 5,718,057 | 2/1998 | Rosli et al. | 101/DIG. 36 |
| 5,803,392 | 9/1998 | Lancy et al. | 242/419.3 |
| 5,813,337 | 9/1998 | Peters et al. | 101/228 |
| 5,816,155 | 10/1998 | Stephan | 101/232 |

*Primary Examiner*—Edgar Burr
*Assistant Examiner*—Daniel J. Colilla
*Attorney, Agent, or Firm*—Walter C. Farley

[57] ABSTRACT

A flat embossing machine for flat material (5) to be embossed has a flat press (2), an embossing table (3) and a tool plate (4). At least one foil web (6) passes through foil loop stores (10, 20) each with a differential pressure device (30) for shaping a foil loop (12) with an air pressure difference exerted on the foil web. A foil feed device (24) and a tensioning device (25) are on each side of the flat press and a foil feed control (52) operates in synchronism with the press cycle so that the foil web is stopped during the embossing phase (TP) on the embossing table (3) and is advanced to the next embossing position during the embossing-free phase. Speed differences between the feed speed (VV) at the embossing location and web speed (V7) at the unwinding roll or at the removal device (V8) are compensated for by corresponding increases and decreases in the size of the loops (L1, L2) in the foil stores. This allows high embossing speeds with optimum quality.

27 Claims, 12 Drawing Sheets

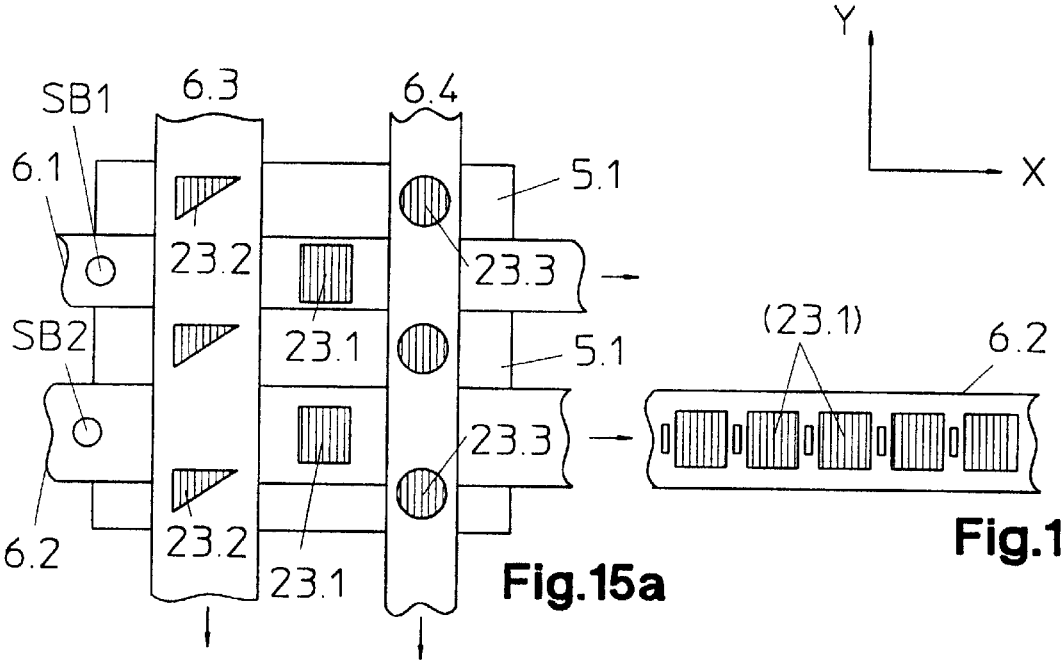
Fig.15a
Fig.15b
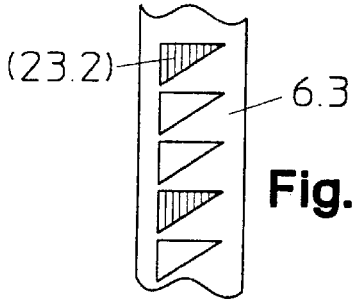
Fig.15c
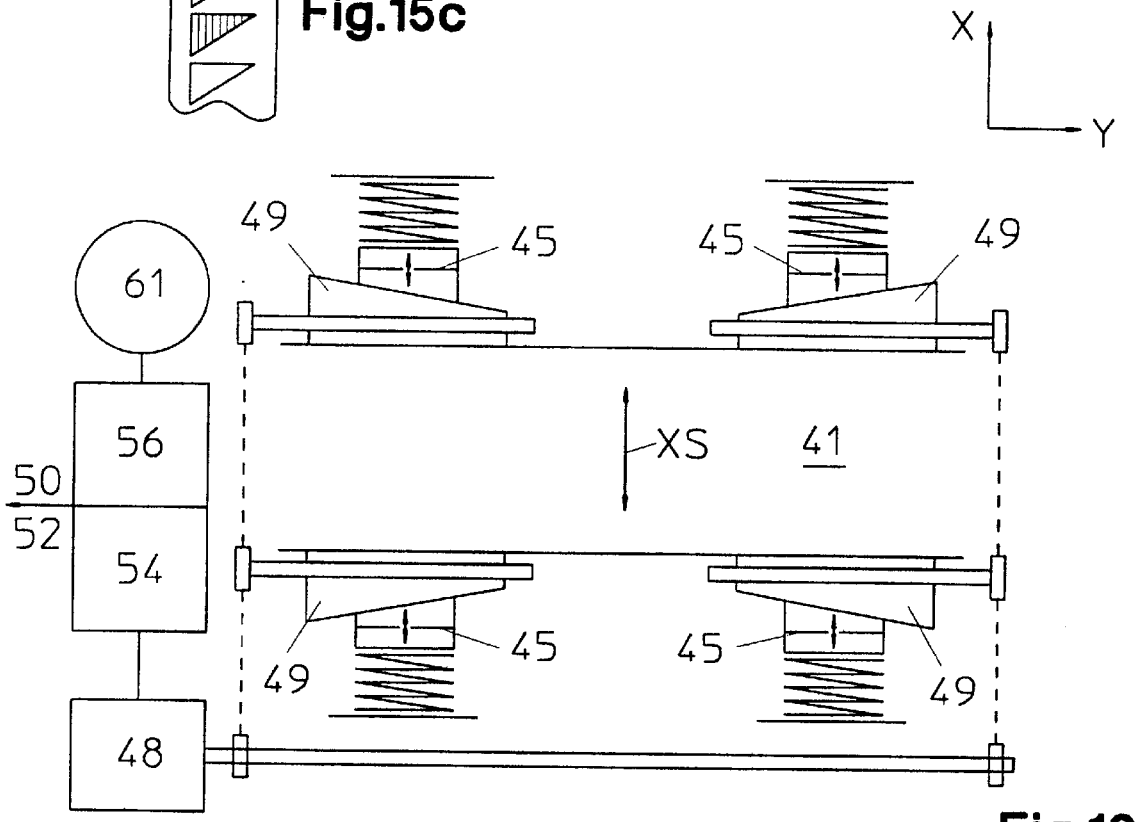
Fig.16

FLAT EMBOSSING MACHINE WITH A FOIL LOOP STORE

FIELD OF THE INVENTION

This invention relates to a flat embossing machine for a flat material to be embossed and having a flat press, an embossing table and a tool plate and a foil web which is drawn from an unwinding roll across the embossing table and is taken up on a foil removal device.

BACKGROUND OF THE INVENTION

In such a machine, with which it is possible to perform embossing functions requiring particularly high quality, during the embossing phase, the embossing foil web must be stopped in an accurately determined position on the embossing table and subsequently, during the non-embossing phase, fed rapidly into the next foil web embossing position. The sensitive embossing foil web must be carefully handled and conveyed. This is difficult to achieve because, as a result of this embossing cycle, there is a very non-uniform feed at the embossing location, while the sluggish unwinding rolls are driven in a substantially uniform manner. The resulting length changes have hitherto been compensated for by floating or dancing rollers. This was possible up to average embossing speeds. However, the foil web speeds, the number of simultaneously processable foil webs and, in particular, the machine speed were limited. Nevertheless, flat-flat embossing geometry permits the highest embossing qualities, particularly for relief printing and for large image formats. An improvement in partial areas could be achieved, e.g., with a register control according to EP-A-708 046 or with an automatic print control according to EP-A-749 001. However, the fundamental limitations still remain.

SUMMARY OF THE INVENTION

An object of the present invention is to provide a flat embossing machine which permits optimum embossing quality, even with very high machine speeds, and which is usable for an extended range of possible embossing tasks with numerous foil webs and complex images. In particular, it is necessary to ensure careful, rapid conveying of several different foil webs.

According to the invention, this object is achieved by a flat embossing machine which employs foil loop stores with a differential pressure device for length compensation purposes, allowing foil web loops to be rapidly and carefully formed in a compact space while, simultaneously, the foil feed device with the associated feed and loop store control assures optimum positioning at the embossing location. The invention also contemplates advantageous further developments relating to improvements in the embossing machine functions and characteristics and allows an even wider range of uses. Particularly advantageous combinations result from the additional adjustment or displacement of the bent lever geometry and embossing time, as well as the print control of the press and register control of the flat material to be embossed.

BRIEF DESCRIPTION OF THE DRAWINGS

The invention is described in greater detail hereinafter with reference to the attached drawings, wherein:

FIGS. 15*a,* 15*b* and 15*c* are plan views of an embossing example with several embossing foil webs and blocks;

FIG. 16 is a top plan view of geometric adjustment of joints of a bent lever press;

DETAILED DESCRIPTION OF PREFERRED EMBODIMENTS

Figure 1:
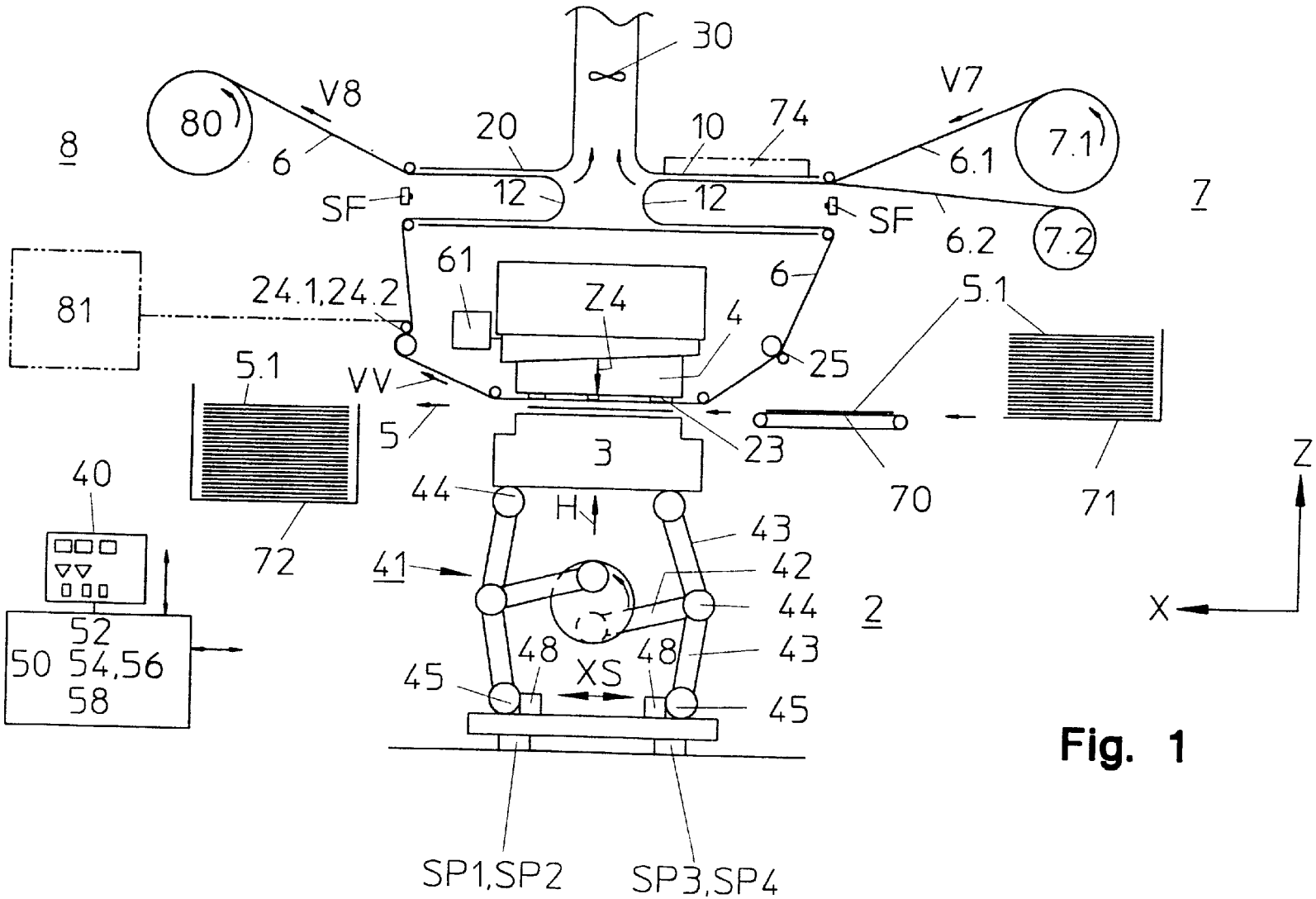
FIG. 1 is a schematic side elevation of an inventive flat embossing machine with foil web stores and feed control.

FIG. 1 schematically shows an inventive flat embossing machine for a flat material 5 to be embossed, with a flat-flat press 2, an embossing table 3 and, as the counterpart, a tool plate 4 with blocks 23, as well as at least one embossing foil web 6. Flat material 5 to be embossed in this embodiment consists of a sheet 5.1, which is guided by a feeder 71, via a register device 70, to flat embossing table 3, where it is embossed in the stationary state and subsequently stacked in a delivery means 72. The press includes a bent lever press 41 with four bent lever pairs 43, with joints 44, 45 and two pairs of tie rods 42. Tool plate 4 is adjustable in the Z-direction by a positioning device 61, e.g., with a motor-driven spindle, which adjusts a sliding wedge. The embossing material is conveyed on one or more foil webs 6, 6.1, 6.2 from unwinding rolls 7, 7.1, 7.2, by means of a first foil loop store 10 upstream of the press and a foil feed device 24 on one side of embossing table 3 and a tensioning device 25 on the other side of the embossing table and subsequently supplied to a foil removal device 8. Foil web 6 can be guided by means of a second foil loop store 20, which follows (is downstream of) the press, to one or more wind-up rolls 80. In place of wind-up rolls 80 it is possible to have a direct foil removal device 81, e.g., in the form of a compacting or shredding means. Foil feed device 24 ensures a precisely controllable, slip-free feed of foil web 6, e.g., by means of light rollers or suction elements, while tensioning device 25 at the embossing table ensures an adjustable, optimum, uniform foil tension, so that the foil is kept stationary at the embossing location in positionally precise, smooth, distortion-free and over-stretching-free manner for embossing purposes. Advantageously, foil feed device 24 follows the press and a tensioning device 25, e.g., which can be a precisely adjustable slip brake with constant braking force or foil tension, is positioned upstream of the press. It is conversely possible with a downstream tensioning device 25 to exert a uniform pull on the foil web which is controlled in a precise, slip-free manner by an upstream foil feed device (e.g., in FIG. 14).

The flat embossing machine has a foil feed and storage control 52 with associated control and display device 40. Thus, the foil feed at the embossing location is controlled in accordance with the flat embossing cycle, the foil web during the embossing phase TP being stopped on embossing table 3 and, during the embossing-free phase TL, is advanced into the next embossing position with a cycle time TO=TP+TL and in which the speed differences between the feed speed VV(t) at the embossing location and the web speed V7 at the unwinding roll or the removal speed V8 are compensated by a suitable reduction or increase in the size of loops L1, L2 in foil stores 10, 20. This feed control VV(t) must take place carefully, precisely and rapidly, so that during the embossing phase TP (cf. FIG. 4) foil web 6 is stopped in a positionally accurate manner on embossing table 3 and is subsequently advanced during embossing-free phase TL rapidly, but carefully, into the next embossing position. As will be explained in conjunction with FIG. 4, there are large and rapidly changing speed differences between the relatively constant unwinding and wind-up speeds V7, V8 on the one hand and the intermittent feed speed VV(t). With foil loop stores 10, 20, these differences are compensated by increasing or decreasing the sizes of loops 12 in the stores. For this purpose, the stores are connected to a differential pressure device 30, which exerts an air pressure difference on the loops 12 in the stores and consequently keeps said loops in a constantly smooth and stretched form.

Figure 17:
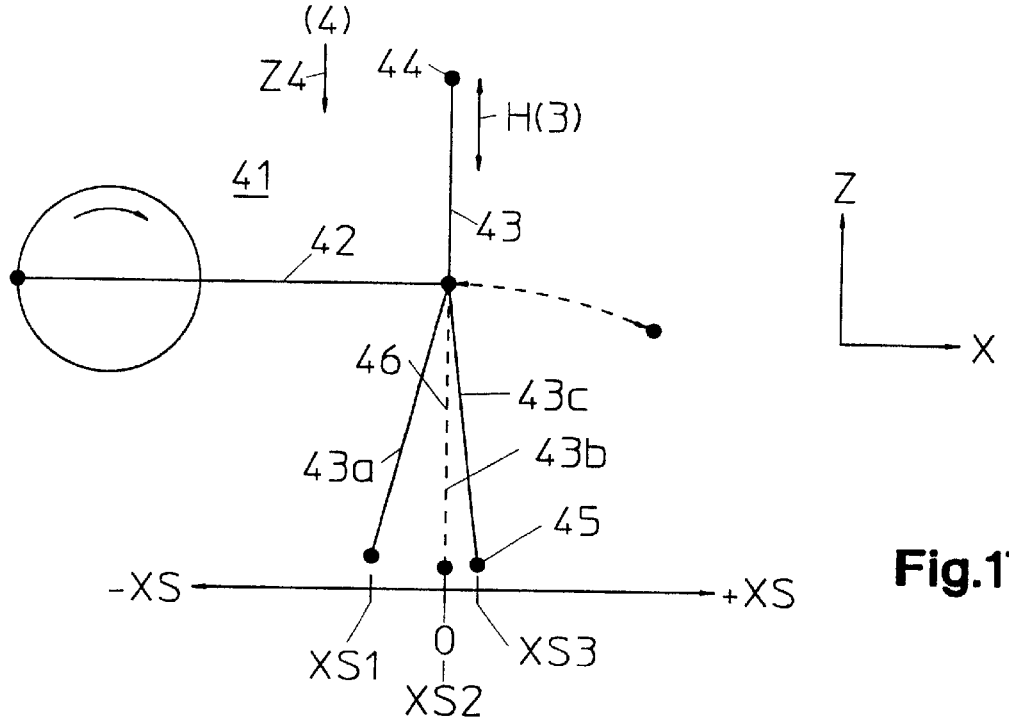
FIG. 17 is a diagram of geometric adjustment of bent levers.
Figure 18A:
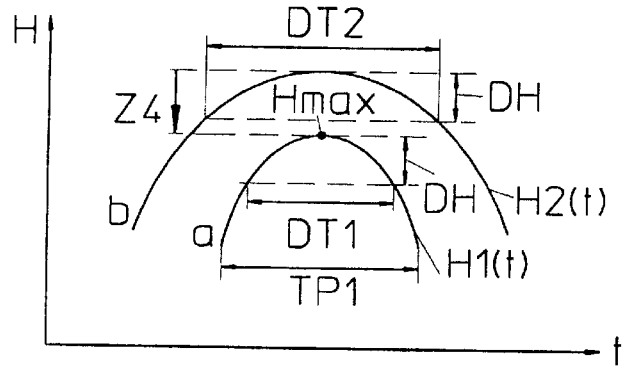
FIGS. 18*a* and 18*b* are graphical representations of lifting or stroke motion paths H of the embossing table as a function of time.
Figure 18B:
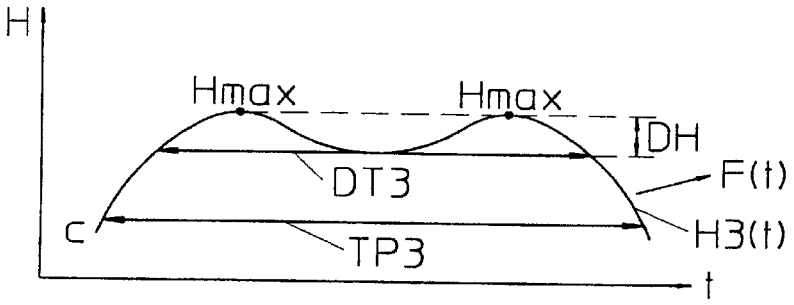
Figure 24:
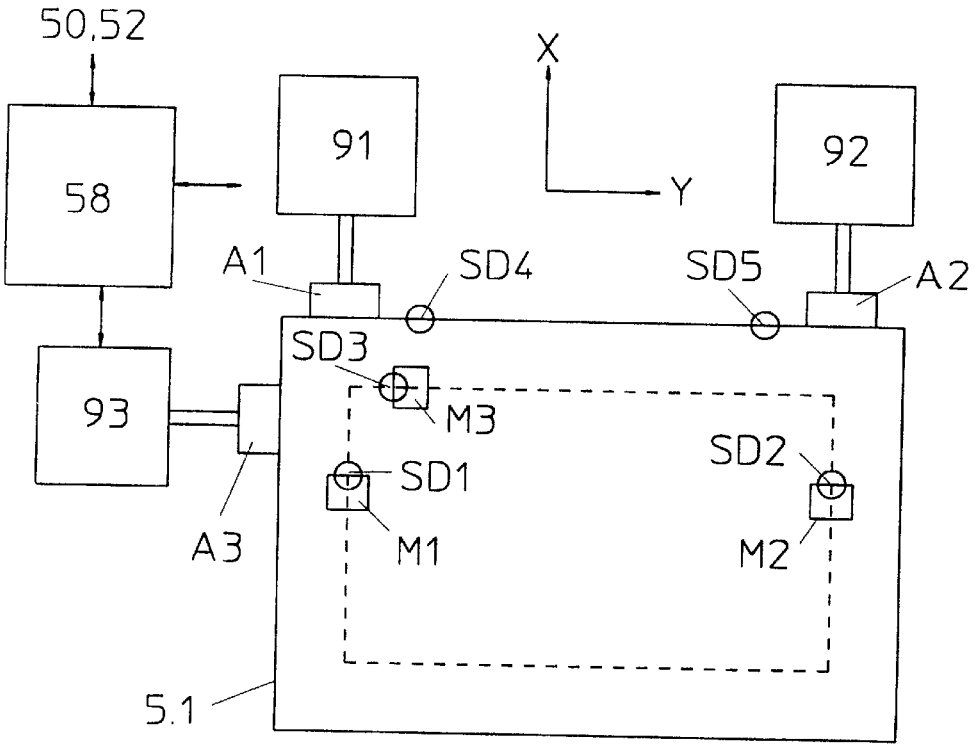
FIG. 24 is a schematic view of a register draw-in device in a sheet-fed machine.
Figure 25:
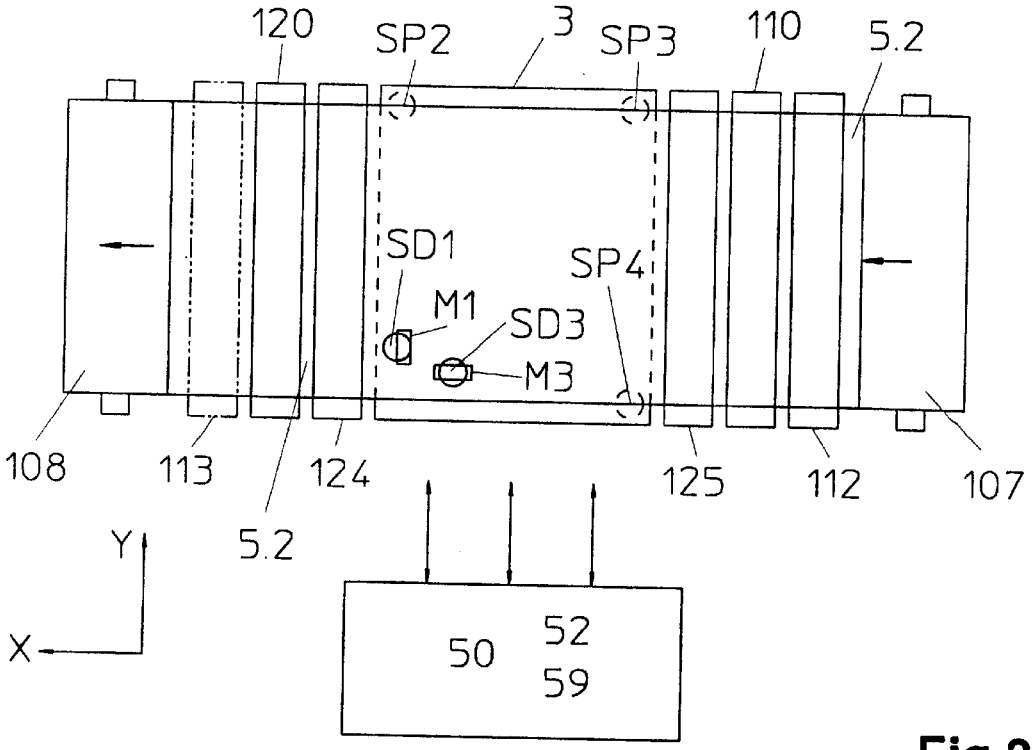
FIG. 25 is a top plan view of a continuous web machine with register control.

In addition to machine control 50 with foil and store control 52, it is possible to integrate further advantageous combinations for control functions (cf. FIG. 3), i.e.:

control of the bent lever geometry 54 and a press embossing control 56, as illustrated by FIGS. 16 to 18; and a register control 58 for sheets according to FIG. 24 or a register control 59 for continuous webs according to FIG. 25.

Figure 2:
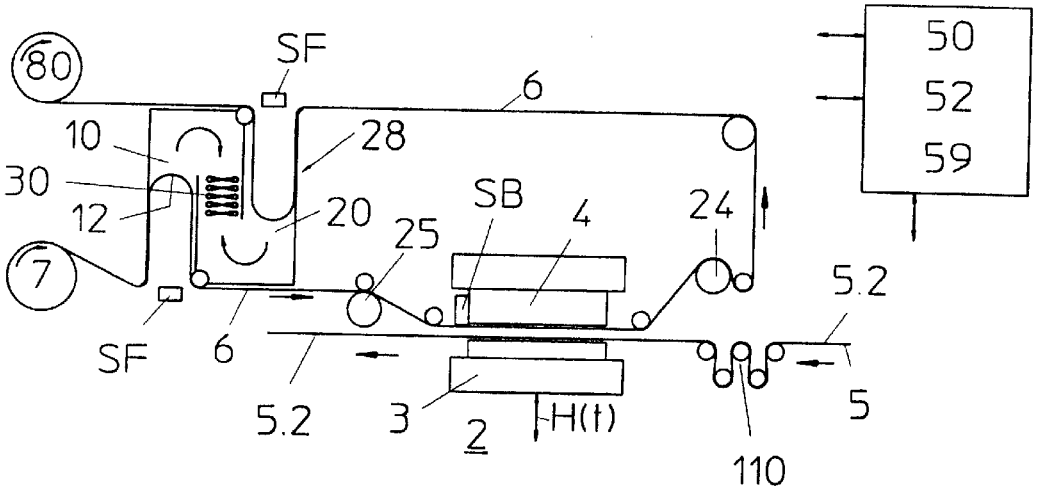
FIG. 2 is a partial schematic side elevation of an example of a flat embossing machine with double stores and a continuous web.

FIG. 2 shows as a further example a flat embossing machine with a continuous web 5.2 as flat material 5 to be embossed with a dancing roller store 110, the flat material and foil web 6 being in this case conveyed in opposition, whereas FIG. 1 illustrates the synchronism of flat material 5 and foil web 6, which is advantageous in many cases. The foil-side speed ratios with respect to VV, V7 & V8 remain the same as described with reference to FIG. 1. Two foil loop stores 10 and 20 are constructed as double labyrinth stores 28 with a common, inner suction means as differential pressure device 30. This represents a particularly simple and compact construction of a double store. For measuring and monitoring loop depth LT and consequently also loop length L in the stores, foil loop sensors SF (cf. FIG. 6) are provided.

Figure 3:
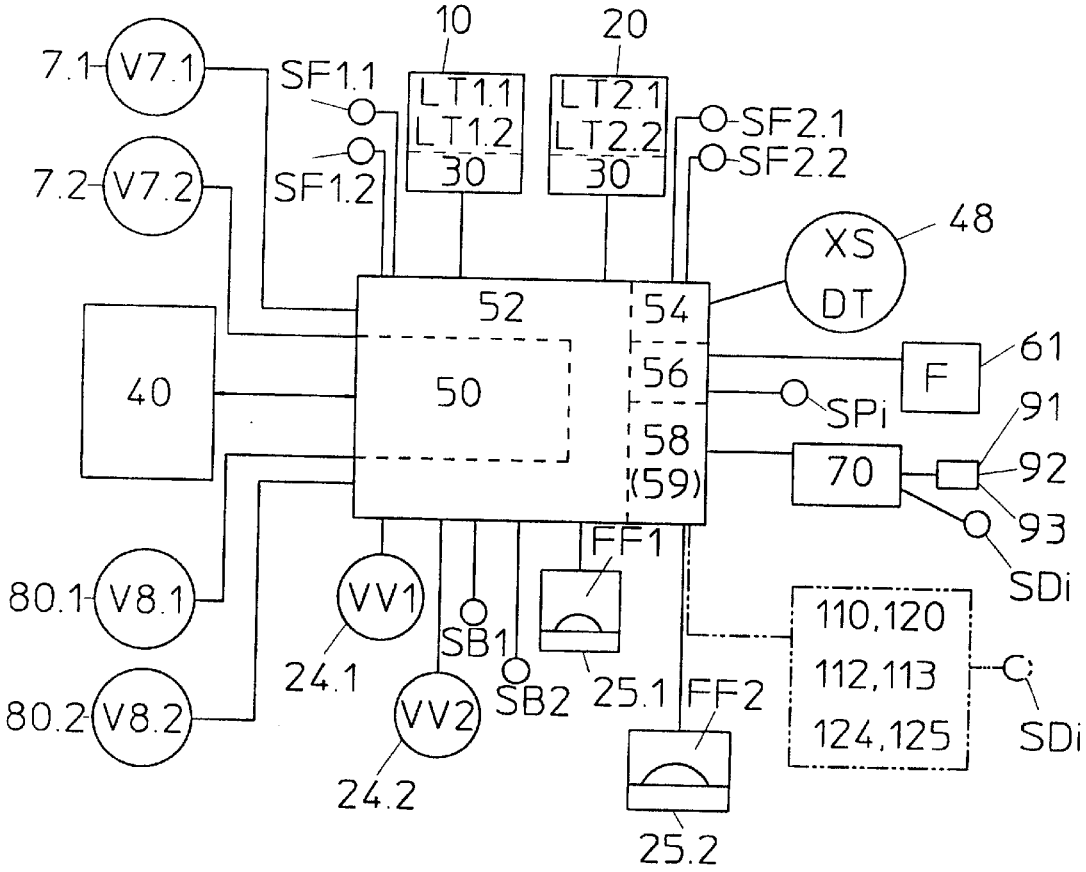
FIG. 3 is a schematic block diagram of an embossing system with foil web storage control, as well as further functions.

FIG. 3 shows a diagram with a machine control 50, a foil web and store control 52, a control of the bent lever geometry 54, a print control 56 and a register control 58 for sheet or continuous web machines 59, as well as with associated sensors SF, SB, SP and SD and with a control and display device 40 for the particular setting and control functions. This embodiment illustrates the controls of a machine with two independently controllable foil webs 6.1, 6.2 with unwinding rolls 7.1, 7.2 and wind-up rolls 80.1 and 80.2, as well as the associated sensors for determining the unwinding speed V7.1, V7.2 and wind-up speed V8.1, V8.2 (e.g., determined from the roll diameter and speed). On foil feed devices 24.1, 24.2 are also determined the corresponding feed speeds VV1, VV2 (e.g., by means of encoders on servomotors). By means of foil tensioning devices 25.1, 25.2, optimum foil tensions FF1, FF2 can be directly or indirectly adjusted and controlled. Thus, foil tensions FF1, FF2 can be matched to the particular foil web and selected embossing process in such a way that the embossing foils are conveyed as carefully as possible without over-stretching, but at the same time there is a precise, stretched orientation and positioning of the foils at the embossing location and this can be adjusted in an optimum manner during the embossing process.

An additional foil image orientation of foil webs 6 with respect to blocks 23 of tool plate 4 can take place using foil image sensors SB1, SB2 (cf. FIGS. 2 and 15*a*). This is, e.g., necessary for embossing holograms or foil images which have to be positioned with accuracy of register on the blocks and from the other side the flat material is positioned relative to the blocks with the register device. Foil and store control 52 also controls and monitors loop formation in the two stores 10 and 20, e.g., by foil web sensors SF1.1, SF1.2 in store 10 and sensors SF2.1, SF2.2 in store 20, which in each case determines loop depths LT1.1, LT1.2 and LT2.1, LT2.2. As advantageous combinations with foil web and store control 52, further functions can be provided in control of bent lever geometry 54, e.g. by adjusting spacing XS of the bent lever fulcrums and therefore influencing embossing time DT, together with control 56 of the impression pressure by means of positioning device 61 of the press with impression pressure sensors SP1 to SP4 (FIG. 1). An advantageous combination is also obtained through a register control 58 for sheet machines with sensors SDi and control elements 91, 92, 93 (according to FIGS. 1 and 19) or a register control 59 for continuous web machines with web stores 110, 120, web edge controls 112, 113 and web feed and tensioning devices 124, 125.

FIG. 4 illustrates, in an example with a five cycle period, feed control VV, foil feed S(t) and loop formation L(t) in the stores, as a function of time, over several embossing cycles. Over four cycles, there is a relatively small foil feed (of, e.g., 7 cm in each case), followed by a large feed in the fifth cycle (of e.g., 77 cm).

Figure 4A:
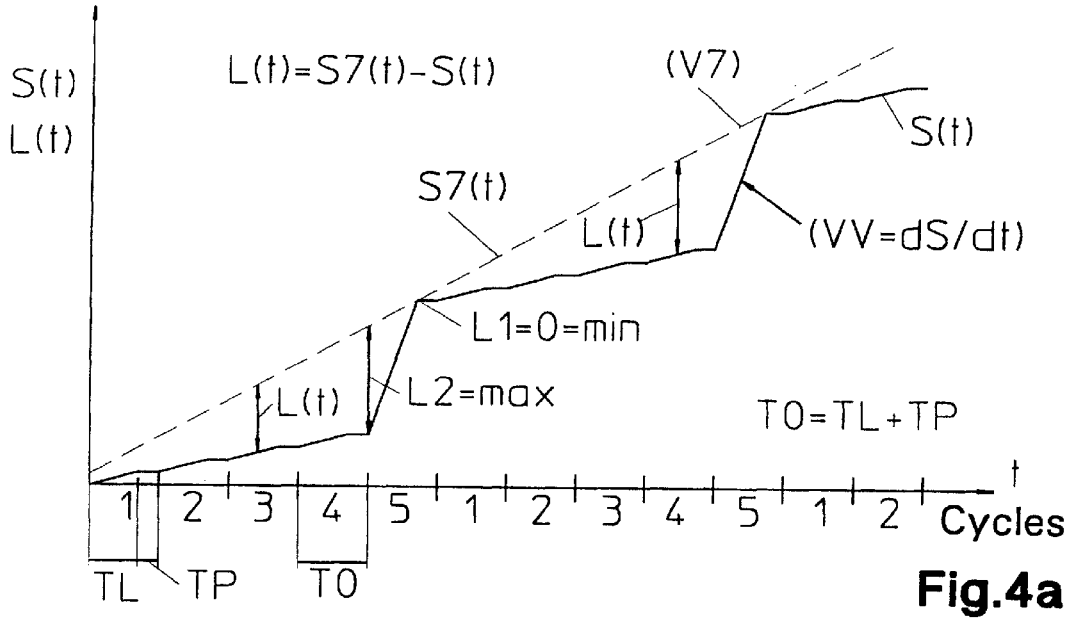
FIGS. 4*a,* 4*b,* 4*c* and 4*d* are graphical representations of the time patterns of foil feed S and loop formation L in the store.

FIG. 4*a* shows the belt conveying S7(t) with a web speed V7(t)=dS7/dt at unwinding roll 7 and feed S(t) with feed speed VV(t)=dS/dt at the embossing location over several periods, in each case consisting of five cycles. The difference between V7 and VV leads to a varying loop length L(t)=S7(t)−S(t), which has a minimum L1 and a maximum L2 of loop length in the stores.

Figure 4B:
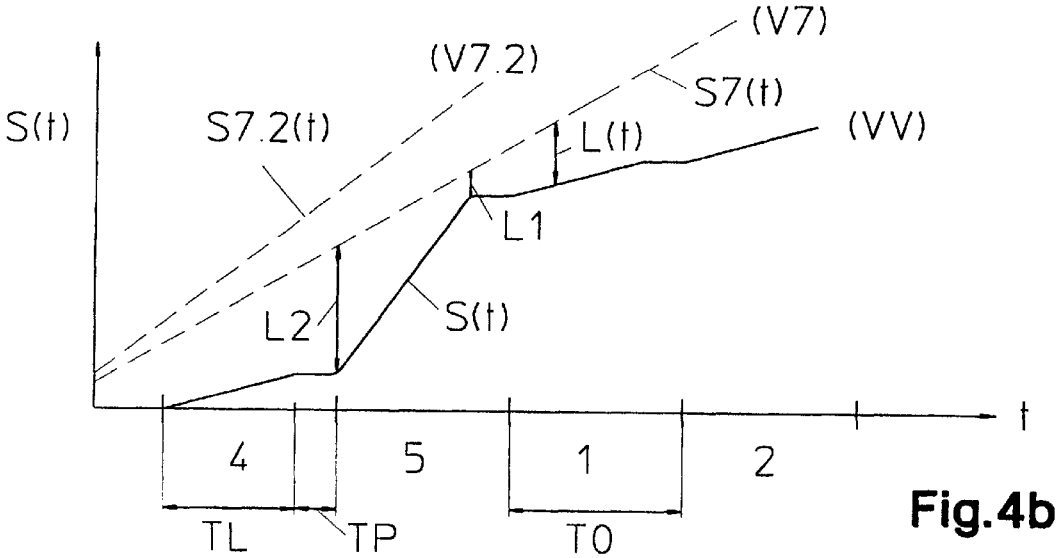

FIG. 4*b* shows this path over cycles 4, 5 and 1 in a more precise manner. Feed S(t) is controlled in an optimally compensated manner without great speed changes, i.e. with minimum accelerations ($d2S/dt^2$). This is important, particularly in the fifth cycle, when in a short time large changes occur to the loop length (from L2 to L1) during the embossing-free phase TL of the cycle. As can be gathered, during the embossing phase TP, and in particular during the embossing time DT, the feed must be S(t)=0, i.e. the foil web must be precisely stationary on the embossing table. Line S7.2(t) shows an example of another time pattern for a second foil web 6.2, which here has a higher unwinding speed V7.2.

Figure 4C:
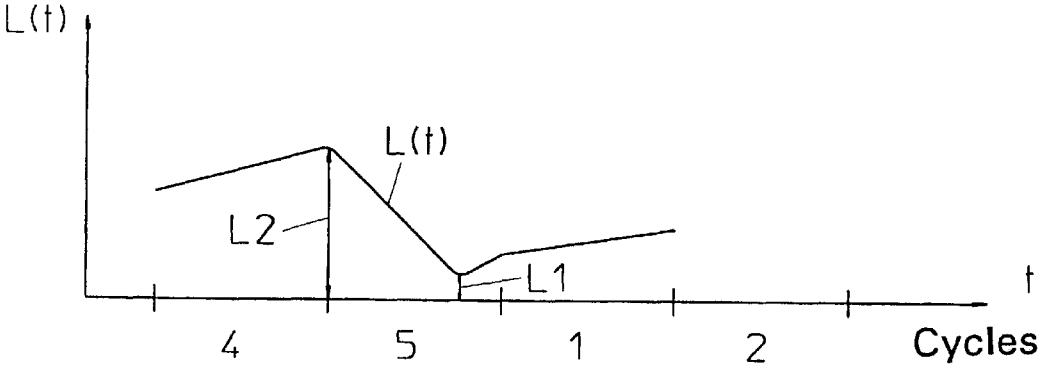

FIG. 4*c* shows the time change of loop length L(t) in the foil loop store 10, in accordance with feed movement S(t) in FIG. 4*b*.

Figure 4D:
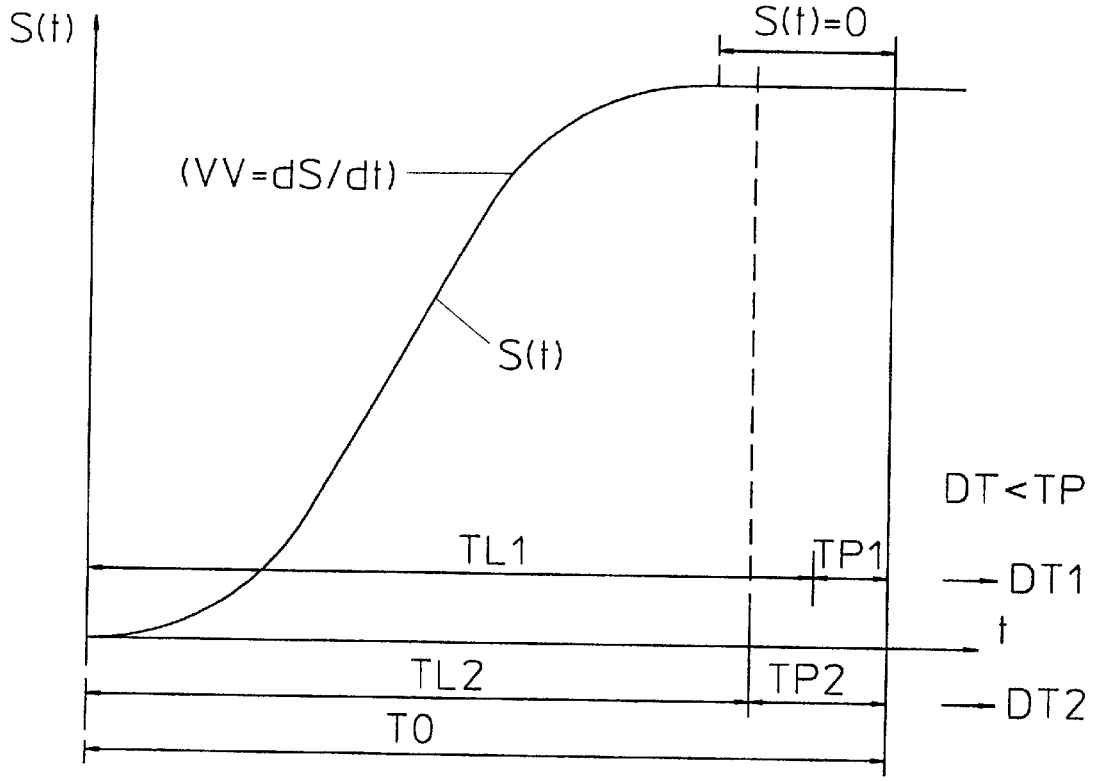

FIG. 4*d* shows on a larger scale feed S(t) in cycle 5, as well as the influence of the adjustment of embossing time DT and consequently also embossing phase TP through a bent lever adjustment according to FIGS. 16 to 18. In the case of a short embossing time DT1 there is a small value of TP1 and, correspondingly, there is a larger range TL1 for modifying feed speed VV and modifying loop length L in the stores. With a long embossing time DT2 and a correspondingly higher value of TP2, in accordance with the relationship TO=TL2+TP2, there is a smaller value of TL2, which is available for foil feed purposes. Particularly in the case of the sought, very high embossing speeds of, e.g., 10,000 cycles per hour and higher, cycle time TO and correspondingly phases TP and TL are very small, which requires correspondingly higher feed speeds during embossing-free phase TL.

Figure 5:
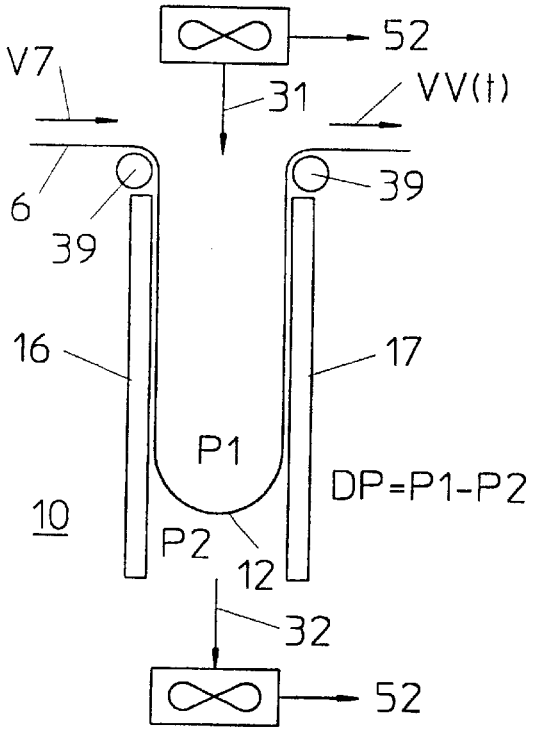
FIGS. 5 and 6 are schematic side elevations of examples of foil loop stores with guide walls and differential pressure devices.

FIG. 5 shows a foil loop store 10 with two guide walls 16, 17, guide pulleys 39 and a controllable pressure fan 31 and/or a suction fan 32 as the differential pressure device. These produce a differential pressure DP=P1−P2 (with P1=pressure in the loop, P2=pressure outside or upstream of the loop) and consequently an adjustable air flow, which substantially runs in the extension direction of loop 12 in the foil store. Foil loop 12 runs along the guide walls 16, 17 and parallel thereto.

Figure 6:
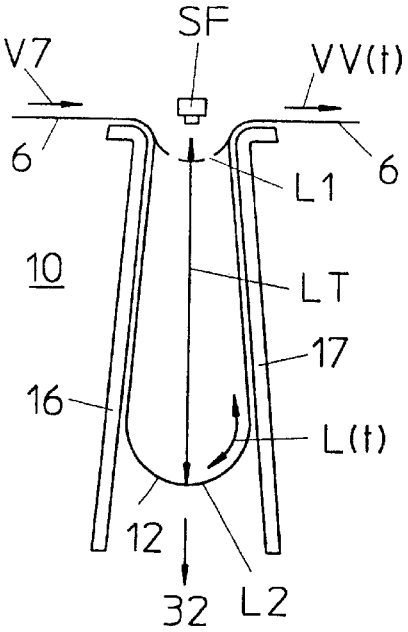

As shown in FIG. 6, guide walls 16, 17 can, e.g., also have a conical configuration, the arrangement of the guide walls (and any side walls) and differential pressure devices being so matched to one another that there is a uniform air flow for an optimum construction of the desired foil loop over the complete range between minimum loop length L1 and maximum loop length L2. The determination and monitoring of loop length L takes place here with a distance sensor SF (which can be, e.g., an optical or ultrasonic detector), which is located at the store inlet and measures loop depth LT, from which loop length L can be calculated.

Figure 7A:
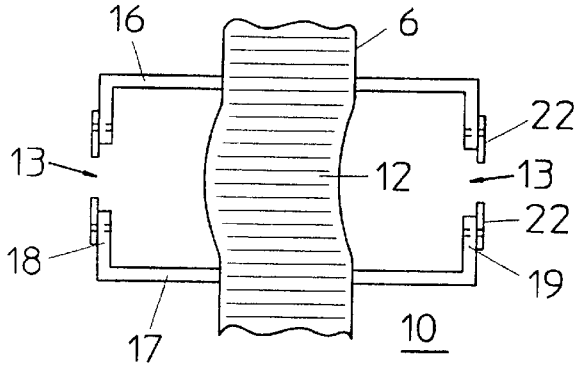
FIGS. 7*a* and 7*b* are a schematic top plan and side elevation of a foil store with adjustable side walls.
Figure 7B:
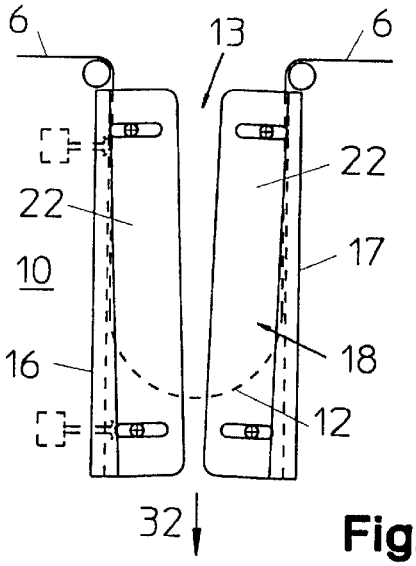

FIGS. 7*a* and *b*, respectively, show a foil loop store with side walls 18, 19 from above and from the side. This embodiment has a further feature of an adjustable store geometry with which, matched to the differential pressure device, it is possible to set an optimum, local flow distribution for perfect loop formation, e.g. also of foil webs of different widths. With displaceable side walls 18, 19 or covers 22 fitted thereto, it is possible to form adjustable openings or slots 13. The said settings of geometry and openings of store 10 can also take place automatically by control elements or can be made controllable by control 52.

Figure 8:
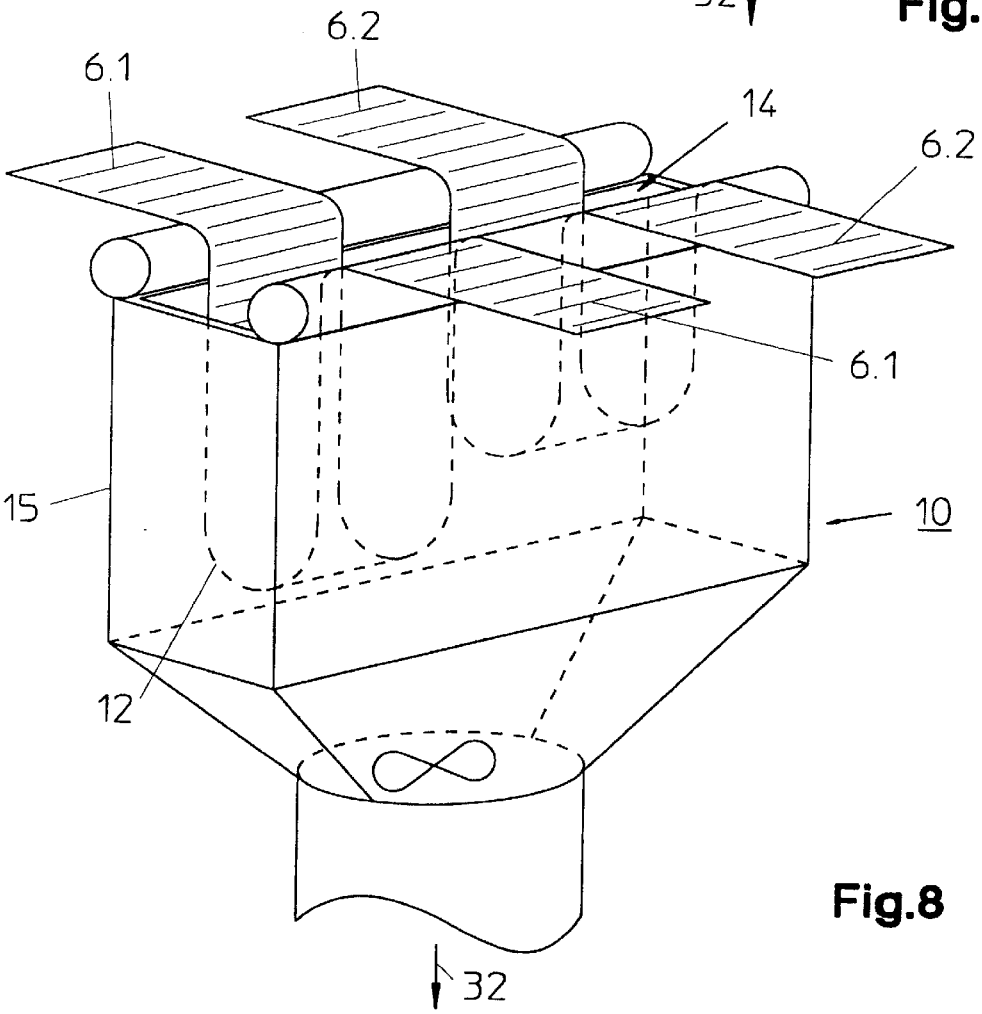
FIGS. 8, 9*a* and 9*b* are a schematic perspective, top plan and side elevational views of suction box stores with variable covers.

A foil loop store according to FIG. 8 has as a further example a suction box 15 with an inlet 14 for foil webs 6.1, 6.2 and with a suction fan 32 at the loop end or at the lower end of the suction box.

Figure 9A:
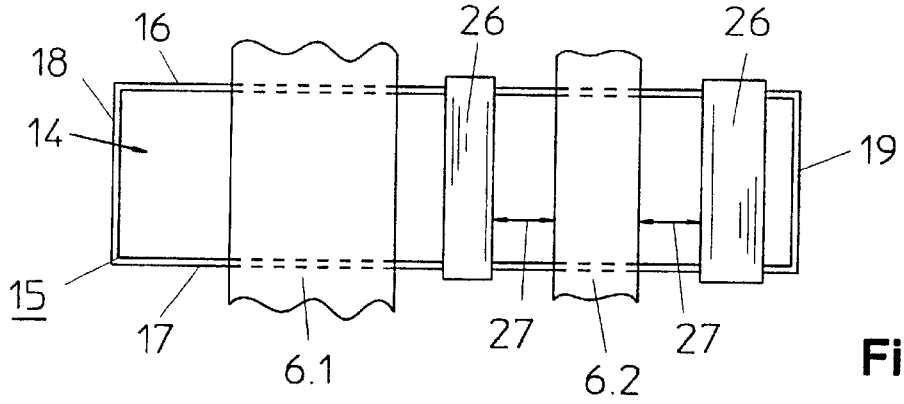
Figure 9B:
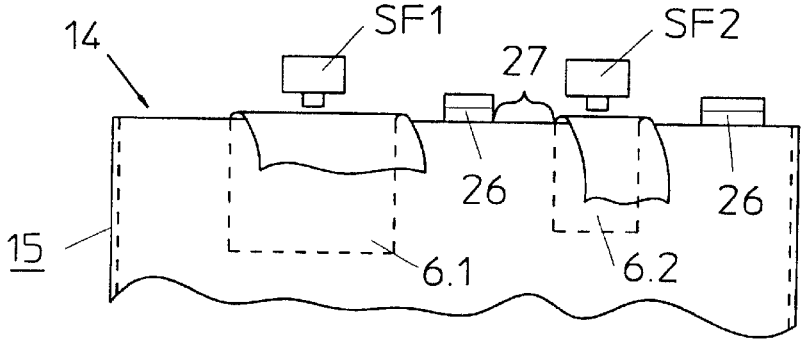

FIGS. 9*a* and *b* show from above and from the side, respectively, a suction box store 15 with variable covers 26 at inlet 14. The loop store can simultaneously receive several foil webs 6.1, 6.2 (different types and widths), which can be conveyed independently of one another and consequently form different loops. For obtaining optimum flow conditions for each loop, it is possible with variable covers 26 on either side of each foil web 6.1, 6.2 to set equal size, free inlets 27.

Figure 10:
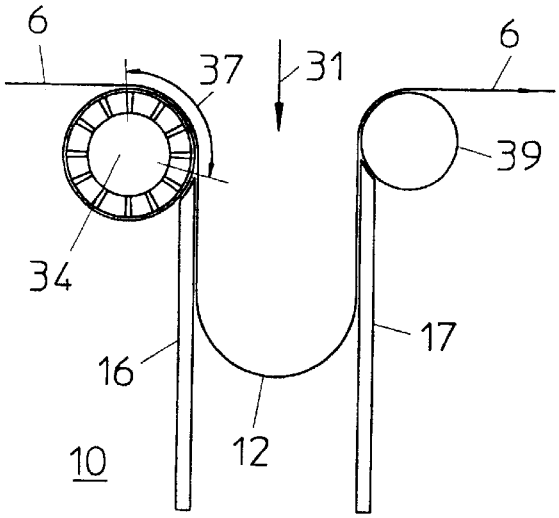
FIG. 10 is a schematic side elevation of a store with a suction roller.
Figure 11:
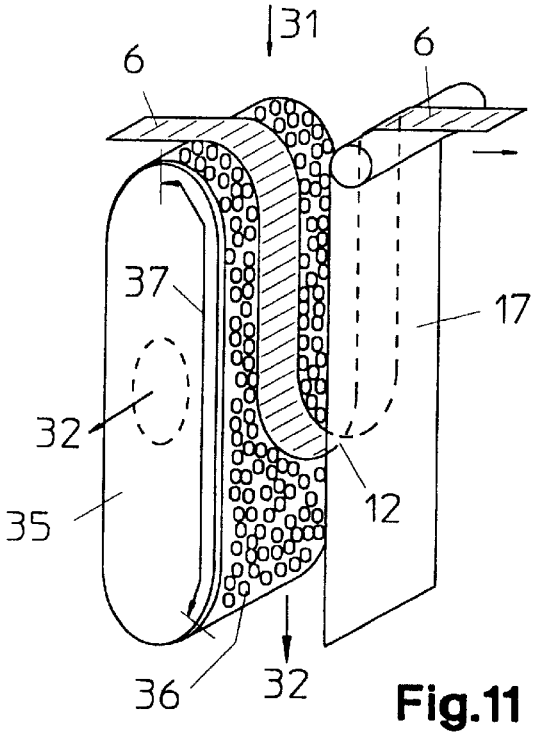
FIG. 11 is a schematic perspective view of a store with a suction wall element and perforated belt.
Figure 12:
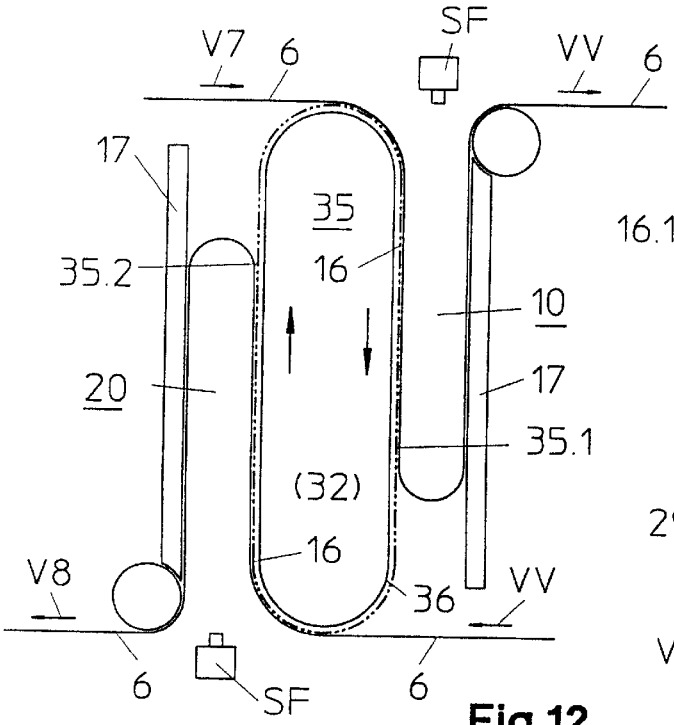
FIG. 12 is a schematic side elevation of a double store with a suction wall element.

As illustrated in FIGS. 10 to 12, the differential pressure devices of the foil loop stores can also have suction rollers 34 or suction wall elements 35 with circumferential perforated belts 36, which are advantageously additionally combined with a pressure or suction fan 31, 32.

FIG. 10 shows at the inlet side a suction roller 34 with a suction area 37 for conveying foil web 6 into the store. Loop formation is assisted here by a pressure fan 31.

In FIG. 11 a perforated suction wall element 35 with circumferential perforated belts 36 conveys foil web 6 over suction and conveying area 37 for forming a loop in the store. This store is, e.g., particularly suitable for long loops with very narrow foil webs.

FIG. 12 shows a suction wall element 35 with a perforated belt 36, whose downwardly moving portion 35.1 forms a conveying wall of a supply store 10 and whose upwardly moving portion 35.2 forms a conveying wall for a discharge store 20.

Figure 13:
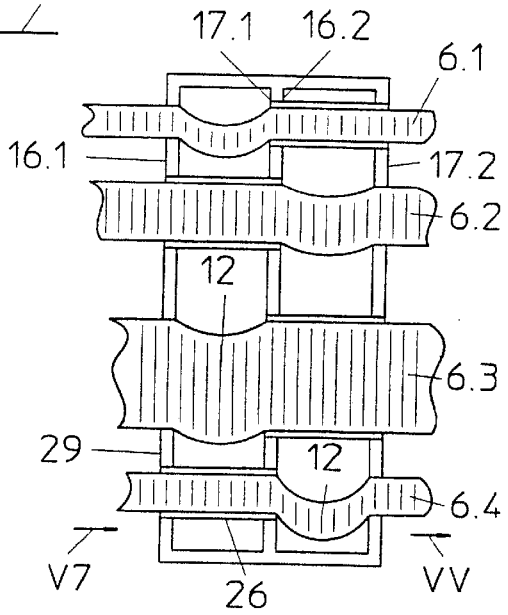
FIG. 13 is a perspective view of a double store with several foil webs.

FIG. 13 shows a double store 29 having two compartments 16.1, 17.1 and 16.2, 17.2, these two compartments having several foil webs 6.1 to 6.4 distributed in an alternating manner and in reciprocally spaced form over the compartments. Both compartments can be operated together with a single differential pressure device.

Figure 14:
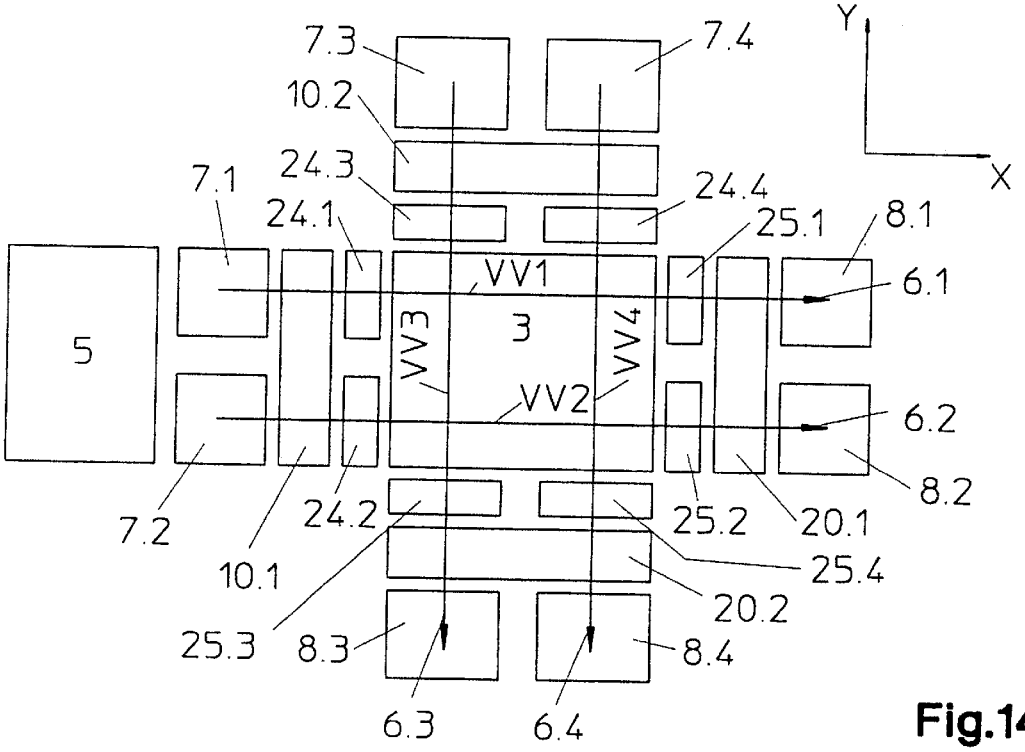
FIG. 14 is a schematic plan view of a machine with several independent longitudinal and transverse foil webs.

FIG. 14 illustrates an example of a machine with several longitudinal and transverse foil webs (in the X and Y-direction), which are individually, independently controllable. Two longitudinal webs 6.1, 6.2 with feed speeds VV1, VV2 have separate feed devices 24.1, 24.2 and tensioning devices 25.1, 25.2, as well as common foil loop stores 10.1, 20.1. Two transverse webs 6.3, 6.4 with feed speeds VV3, VV4 have separate feed devices 24.3, 24.4 and tensioning devices 25.3, 25.4, as well as common foil loop stores 10.2, 20.2.

FIG. 15 illustrates an embossing operation with several different embossing foil webs with different embossing materials and different blocks, which are simultaneously formed in an embossing process. Through the arrangement of the foil webs in the longitudinal and transverse directions, simultaneous embossing can take place with more blocks and more complex images. The prerequisite is that there are no blocks in the crossing areas of the foil webs. As a simple example, FIG. 15 shows a sheet 5.1 to be embossed in the Y-direction, which is subdivided into two identical areas. In the X-direction, and using two identical foil webs 6.1, 6.2, embossing takes place with image units corresponding to blocks 23.1. The accuracy to register of these foil image units with respect to blocks 23.1, and consequently also with respect to sheet 5.1 to be embossed, is monitored and controlled by foil image sensors SB1, SB2 (which detect foil image marks). In the Y-direction, two foil webs 6.3, 6.4 with different color coatings travel as the embossing material and have associated blocks 23.2, 23.3.

FIG. 15*b* shows the embossed image foil web 6.2 and FIG. 15*c* the embossed color foil web 6.3 with a 3 cycle period. The arrangement of the foil webs and their individual feed controls takes place in such a way that the foil embossing material is utilized in an optimum manner. With the inventive combination of compact, very rapidly responding, common loop stores for several, independently controllable foil webs, a flat embossing machine is provided which is able to carry out very demanding, complex embossing tasks in a single path at high speed and with optimum quality, and in which, additionally, the foil webs are less stressed and the embossing material can be utilized in an optimum form.

FIGS. 16 to 18 illustrate the combination of the inventive machine with a geometric adjustment or displacement or an embossing time displacement (DT). Optimization is possible in two dimensions, i.e. by means of two independent setting quantities: both with respect to the foil feed S(t) and with respect to the embossing process with the embossing time DT. This leads to maximum embossing quality and universal use possibilities. FIG. 16 shows from above a geometric adjustment of a bent lever press with four bent lever pairs, the lower four bent lever joints 45 (cf. FIG. 1) being simultaneously adjusted by a servo drive 48 through a transmission to the four joints 45. The adjustment takes place, e.g., by, in each case, one spindle and an adjusting wedge 49, so that the spacing XS of joints 45 is adjustable by controllable motors 48 and a geometric control 54. However, other drive forms (e.g., hydraulic or hand drive) are also possible and all four joints 45 can be directly displaced with in each case one synchronously controlled motor. The adjustment can be programmable and preferably takes place stepwise only during the embossing-free phase (TL).

FIG. 17 illustrates the geometrical adjustment on one of the bent lever pairs 43 which are moved by tie rods 42. As a function of the setting XS of lower joints 45, there are different patterns of the stroke maxima H(t) of the press, as illustrated by the three following setting examples.

With the setting XS1<0, there is a maximum deflection position 43*a,* in which bent levers 43, 43*a* do not completely reach their stretched position 6.

With the setting XS2=0, in the maximum deflection position 43*b* the stretched position 46 is just reached.

With the setting XS3>0, the stretched position 46 is exceeded up to the maximum deflection 43*c.*

According to FIGS. 18*a* and *b,* this gives the following movement paths to stroke H(t) of the press as a function of time:

a) For XS1<0 (e.g., −3 mm) there is curve H1(t) with a narrow maximum for a given height difference DH giving an embossing time DT1 of, e.g., 25°.

b) For XS2=0, curve H2(t) is obtained with a wider maximum and for the given DH a longer embossing time DT2 of, e.g., 35°.

c) For XS3>0 (e.g., +1 mm), there is a curve H3(t) with two maxima Hmax and for the given DH a correspondingly longer embossing time DT3 of, e.g., 42°.

Height difference DH results from the extent to which a given flat material 5 to be embossed can be compressed. This also leads to the path of the press impression pressure F(t) corresponding to the stroke or lift motion H(t). If in case a) the stretched position 46 is not completely reached, tool plate 4 must be readjusted in direction Z4 by positioning device 61 in order to compensate for the missing height H. As shown in FIGS. 18*a,* 18*b,* embossing phase TP is necessarily somewhat longer than embossing time DT. This can for cases a, b and c be, e.g., TP1=40°, TP2=50° and TP3=60°. Correspondingly, there is a change to the embossing-free phase TL according to the relationship TO=360°=TP+TL (cf. FIG. 4).

Another, particularly advantageous, combination results from the integration of a print control in the machine, as known from EP-A-749 001. For this purpose the embossing machine has sensors SP1 to SP4 for measuring the press impression pressures F (cf. FIGS. 1 and 16). Print control 56 controls, through positioning device 61, tool plate 4 in direction Z4 so that a desired, predetermined operating pressure F is automatically constantly maintained. The print control can also contain different functions for impression pressure control. With bent lever geometric control 54 and press print control 56, both with respect to the embossing time DT and the embossing impression pressure F, optimum parameter values can be set and therefore maximum embossing quality and machine productivity values obtained. This control of the bent lever geometry and embossing phase can also be used independently of the inventive loop stores for optimizing embossing quality.

In a machine according to the invention it is possible to process in a optimum manner foils of the most varied types and widths. In particular, very wide and very thin foils with a thickness of, e.g., 15 to 30$\mu$ are extremely difficult to transport in a completely satisfactory manner. The insulating plastic support material of the foils is electrostatically charged, which can lead to relatively high frictional forces on the guide walls (entry wall 16 and exit wall 17) of the stores in certain circumstances, which can lead to distortion and shrinkage of the foil webs. According to an important further development of the invention, the frictional forces of the foil webs running over the same, particularly at entry wall 16 of the loop stores are to be kept low or reduced to a level enabling loop formation and transportation to take place in an optimum manner.

Different measures and means for this are illustrated in FIGS. 19 to 23.

Figure 19A:
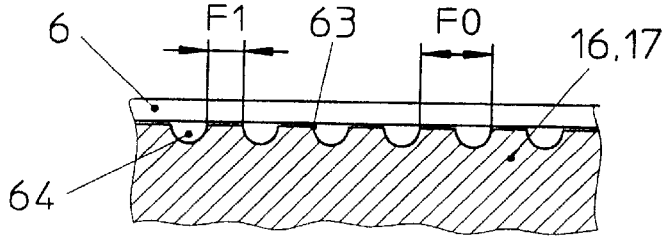
FIGS. 19*a,* 19*b* and 19*c* are examples of structured or textured guide surfaces.
Figure 19B:
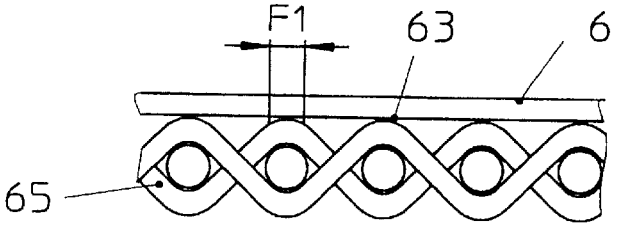
Figure 19C:
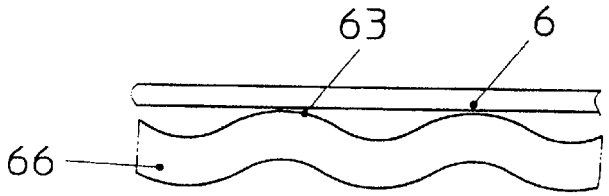
Figure 20:
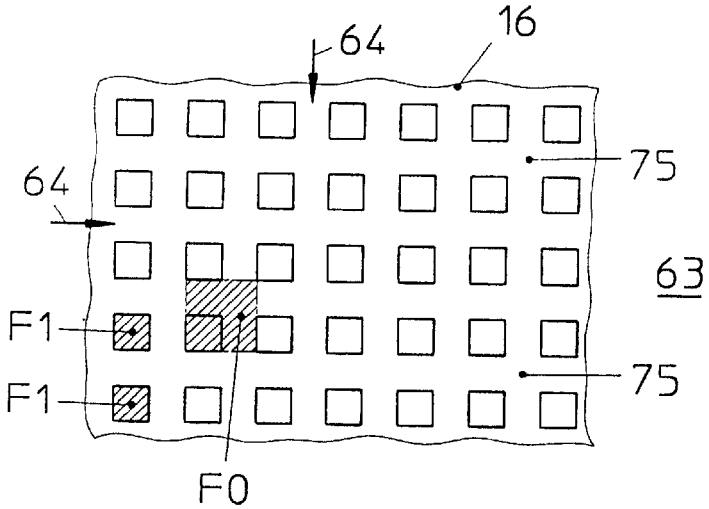
FIG. 20 is a plan view of a textured entry wall with injection openings.

FIGS. 19 and 20 show structured or textured surfaces 63 on guide walls 16, 17, their surfaces F1 in contact with the foil running above the same being significantly smaller than the whole surface F0 covered by the foil. The ratio of contacted to covered surface F1/F0 is smaller than 50% and preferably even less, e.g. 10 to 30%.

Such textured surfaces 63 can be formed in different ways, e.g., by grooves or channels 64, according to FIGS. 19*a* and 20, or by lattices or fine-mesh gauze wires 65 according to FIG. 19*b,* or by perforated plates, knobbed plates or corrugated plates 66 according to FIG. 19*c.* The lattice constant or texture spacings of these textured surfaces are preferably only 1 mm or less, e.g., 0.3 to 1 mm.

FIG. 20 shows in plan view an example of a textured surface with longitudinal and transverse channels 64, a surface ratio F1/F0 of approximately 25% being illustrated here.

Figure 21:
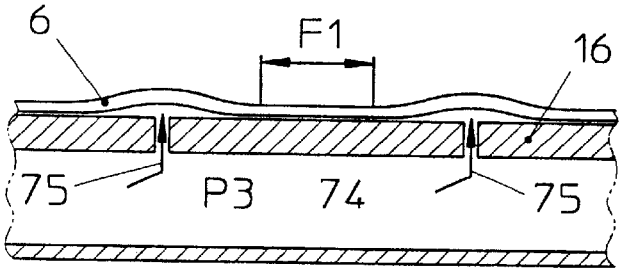
FIG. 21 is a side elevation of a ventilated entry wall.

Another particularly simple and effective method for reducing contact surface fraction F1 or the frictional force of the foil web at entry wall 16 involves detaching the foil web partially from the entry wall by partially blowing in air, as illustrated in FIG. 21. Entry wall 16 has injection holes 75, through which air can be locally blown under the foil from an over-pressure chamber 74. This air-assisted reduction of the frictional force on the entry wall, corresponding to the foils to be transported, can easily be dosed by controlling the over pressure P3 in chamber 74, which can, e.g., be 2 to 4 bar. Exhaust openings 75 are preferably relatively small and positioned with large mutual spacings. The diameters of the exhaust openings are, e.g., 1 mm or less each and the spacings are several centimeters, e.g., 5 to 20 cm. It is important that the foil always remains on the guide wall and is not completely removed, i.e., contact surface fraction F1 is not zero. This ensures smooth, perfect guidance of the foil web. The guide walls are metallic and conductive and the vented entry walls can have a smooth surface (FIG. 21) or a textured surface (FIG. 20).

Figure 22:
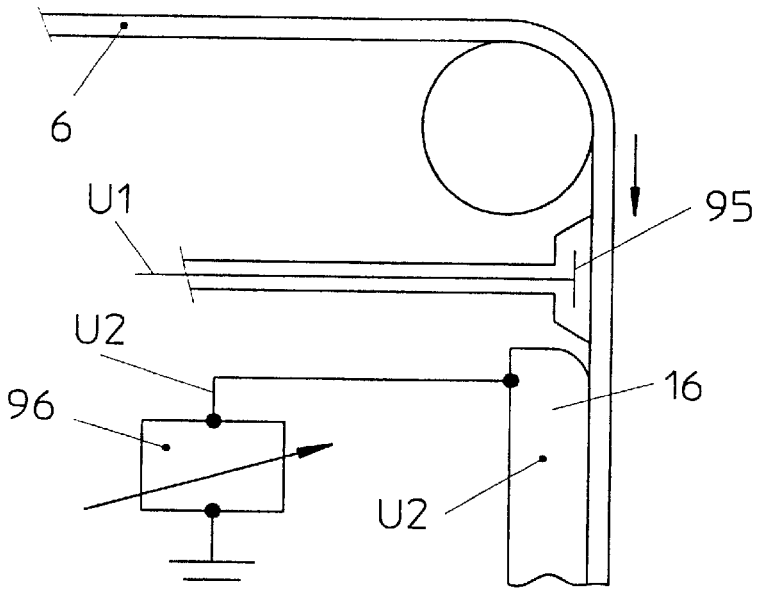
FIG. 22 is a plan view of an entry wall with applied potential.

FIG. 22 shows a further variant for reducing the frictional force by applying a potential U2 to entry wall 16 with an adjustable voltage source 96. The entry wall is metallic and conductive and is insulated from the surroundings. Thus, the potential difference U1−U2 between the foil web and guide wall 16 is reduced to such an extent that the desired low frictional force value is reached. Potential U2 is so set at entry wall 1 that there is optimum, smooth loop formation and foil guidance. Additionally, potential U1 of foil web 6 can be determined by a capacitive potential probe 95 and subsequently potential U2 can be adjusted or regulated.

Figure 23:
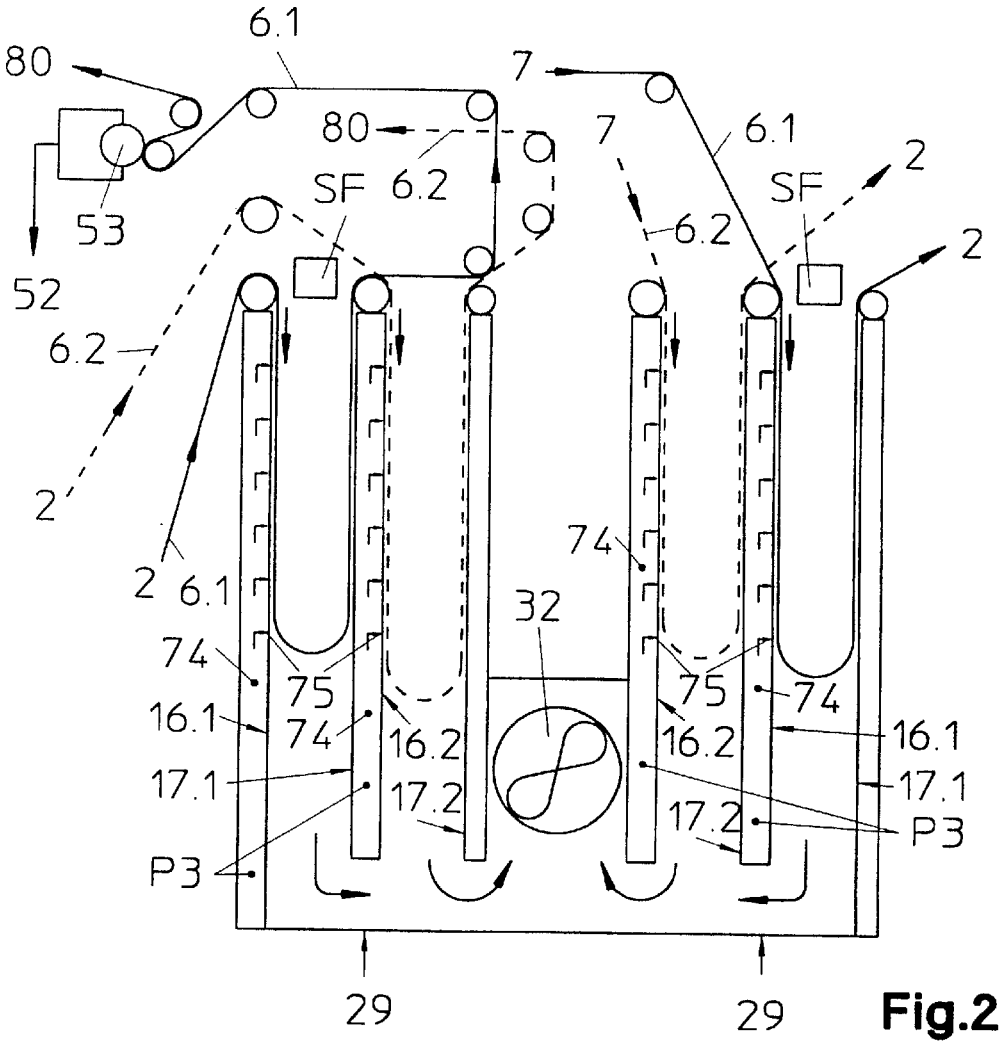
FIG. 23 is a schematic side elevation of a twin-compartment store with ventilated entry walls.

FIG. 23 shows an example with, in each case, a twin-compartment store 2 upstream and downstream of the embossing press and with, in each case, one foil web 6.1, 6.2 in, in each case, one compartment of said two stores. The loop formation in the stores takes place by vacuum suction produced by a common suction fan 32. The four entry walls 16.1, 16.2 have air communication with over-pressure chambers 74 in which there is a pressure P3 through injection openings 75. The four exit walls 17.1, 17.2 are not vented. The frictional force at the exit walls is consequently intentionally higher than at the entry walls, so that the foil web is slightly tensioned for completely satisfactory transportation purposes. A sliding wheel 53 with rotator determines the speed and feed of the exiting foil web, so that the motor of the wind-up roll 80, as well as the feed and loop formation in the stores, are controlled.

FIG. 24 shows the combination of the inventive flat embossing machine with a flat material register control 58. This combination permits two-sided optimization, both on the foil web side with respect to the foil guidance and orientation, and with respect to the flat material guidance for precise image orientation. On the foil side, e.g. foil subjects such as holograms or foil images are precisely oriented by means of foil image sensors SB (FIGS. 15*a* and 2) with respect to blocks 23 on tool plate 4, while sheets 5.1 are also oriented in a positionally accurate manner with respect to the position of the blocks by register control. Such a register control for sheet-fed machines is known from EP-A-708 046.

Register draw-in device 70 for flat embossing machines has leading edge stops, a side stop and position sensors SD1, SD2, SD3 for detecting print marks M1, M2, M3 of sheet 5.1, as well as tow detectors SD4, SD5 associated with front stops A1, A2 for detecting the sheet leading edge. Front stops A1, A2 are adjustable by control elements 91, 92 until front print marks M1, M2 of the sheet are detected by the corresponding sensors SD1, SD2. A control element 93 subsequently adjusts the side stop or side slide A3 to such an extent that the side print mark M3 is detected by the associated position sensor SD3. A register control 58 controls this register correction with position sensors SD1, SD2, SD3, detectors SD4, SD5 and control elements 91, 92, 93. This gives in a simple manner a reliable, automatic register correction for each individual sheet and consequently increases the embossing quality in combination with the foil guidance and control.

FIG. 25 schematically shows from above a register control 59 for continuous web machines (FIG. 2) with sensors SD1, SD3 for detecting print marks M1, M3. Continuous web 5.2 runs from an unwinding roll 107 to a wind-up roll 108 with web edge controls 112, 113, web stores 110, 120 (constructed as dancing rollers or suction stores), a web tensioning device 125 and a web feed device 124. The orientation of the continuous web in the transverse direction Y to print mark M3 takes place through per se known web edge controls 112 and 113 and the orientation to mark MI in the longitudinal direction X is controlled by web feed device 124. For compensating the differences between the intermittent feed at embossing table 3 and the uniform unwinding speed at rolls 107, 108, in the same way as for foil web control, here again use is made of web stores 110, and 120 for continuous web 5.2.

We claim:

1. A flat embossing machine for embossing a flat material comprising the combination of a flat press (2) with an embossing table (3) and a tool plate (4);

control means for operating said press in a press cycle (TO) comprising alternately an embossing phase (TP) and an embossing-free phase (TL);

at least one elongated foil web (6) for conveying material to be embossed;

means for guiding said at least one foil web from an unwinding roll (7) across said embossing table to a foil removal device (8), at least one foil loop store (10) having a differential pressure device (30) for forming at least one foil loop (12) in said at least one foil web (6) by establishing an air pressure difference across said at least one foil web;

a foil feed device (24) on one side of said press and a tensioning device (25) for exerting a tension force on said at least one foil web on the other side of said press;

said control means further comprising means for controlling said foil feed device and said tensioning device such that said at least one foil web is kept stationary with a longitudinal web speed of zero in an embossing position on said embossing table during the entire duration of said embossing phase (TP) and such that said at least one foil web is longitudinally advanced to a next embossing position during said embossing free phase (TL) by continuously accelerating and then continuously decelerating to zero web speed said at least one foil web, said web having a feed speed VV at said embossing location, an unwinding web speed V7 at said unwinding roll (7) and a web speed V8 at said foil removal device, wherein VV≠V7≠V8 during at least portions of said press cycle;

said control means controlling said at least one foil loop store to increase and decrease the size of said at least one loop in response to inequalities of said speeds to compensate for differences in said speeds and to permit movement of said at least one foil web.

2. An embossing machine according to claim 1 wherein said at least one foil loop store comprises a first foil loop upstream of said press and a second foil loop downstream of said press relative to a longitudinal direction of movement of said at least one foil web.

3. An embossing machine according to claim 1 wherein said differential pressure device comprises at least one of a controllable pressure fan (31) and a suction fan 32 producing an adjustable air flow in a direction of said at least one foil loop in said foil store, and wherein each said at least one foil loop store comprises first and second guide walls (16, 17) parallel to said foil loop.

4. An embossing machine according to claim 3 wherein each said at least one foil loop store comprises third and fourth side walls (18, 19) with adjustable openings therein.

5. An embossing machine according to claim 1 wherein each said at least one foil loop store comprises an adjustable geometry (13, 26) for modifying local flow distribution.

6. An embossing machine according to claim 1 wherein said at least one foil loop store comprises a suction box (15) with an inlet (14) for said foil web and a suction device (32) at a loop end.

7. An embossing machine according to claim 1 wherein said at least one foil loop store includes an inlet with an adjustable cover (26).

8. An embossing machine according to claim 1 wherein each said at least one foil loop store comprises one of a suction roller (34) and a perforated belt (36) with a suction fan (32) for transporting said foil web.

9. An embossing machine according to claim 1 wherein each said at least one foil loop store comprises a fixed, perforated suction wall element (35) with a vacuum in an interior thereof, and a perforated belt (36) running around said element and continuously transporting said foil web.

10. An embossing machine according to claim 9 wherein said perforated belt runs around a bilateral suction wall with upwardly and downwardly directed portions forming a guide wall of two adjacent foil loop stores.

11. An embossing machine according to claim 1 comprising distance sensors (SF1, SF2) for measuring loop depth and for monitoring loop formation.

12. An embossing machine for embossing a flat material (5) comprising the combination of a flat press (2) with an embossing table (3) and a tool plate (4);

control means for operating said press in a press cycle (TO) comprising alternately an embossing phase (TP) and an embossing-free phase (TL);

a plurality of elongated foil webs (6.1, 6.2, 6.3) for conveying material to be embossed;

means for separately guiding said plurality of foil webs from unwinding rolls (7) across said embossing table to a foil removal device (8);

at least one foil loop store (10) having a differential pressure device (30) for forming at least one foil loop (12) in said foil webs (6) by establishing an air pressure difference across said foil webs;

a plurality of foil feed devices (24.1, 24.2) on one side of said press and tensioning devices (25) for exerting a tension force on said foil webs on the other side of said press for feeding said foil webs at different feed speeds (VV1, VV2);

said control means further comprising means for controlling said foil feed devices and said tensioning devices such that said foil web is kept stationary with a longitudinal web speed of zero in an embossing position on said embossing table during the entire duration of said embossing phase (TP) and such that said at least one foil web is longitudinally advanced to a next embossing position during said embossing free phase (TL) by continuously accelerating and then continuously decelerating to zero web speed said foil webs, said webs having feed speeds (VV1, VV2) at said embossing location, an unwinding web speed V7 at said unwinding roll (7) and a web speed V8 at said foil removal device, wherein said feed speeds ≠V7≠V8 during at least portions of said press cycle;

said control means controlling said at least one foil loop store to increase and decrease the size of said at least one loop in response to inequalities of said speeds to compensate for differences in said speeds and to permit movement of said foil webs.

13. An embossing machine according to claim 12 wherein said foil stores comprise double loop stores (28, 29) for a plurality of foil webs.

14. An embossing machine according to claim 12 wherein said plurality of foil webs move is one direction and said webs are arranged transversely to said direction.

15. A flat embossing machine for a flat material to be embossed comprising the combination of a flat press (2) with an embossing table (3) and a tool plate (4);

control means for operating said press in a press cycle (TO) comprising alternately an embossing phase (TP) and an embossing-free phase (TL);

at least one elongated foil web (6) for conveying material to be embossed;

means for guiding said at least one foil web from an unwinding roll (7) across said embossing table to a foil removal device (8), at least one foil loop store (10) having a differential pressure device (30) for forming at least one foil loop (12) in said at least one foil web (6) by establishing an air pressure difference across said at least one foil web, said at least one loop store including guide walls having means for reducing frictional forces acting on said foil web as said web passes over said guide walls so that said frictional force along an entry wall of said loop store is smaller than frictional force on an exit wall thereof;

a foil feed device (24) on one side of said press and a tensioning device (25) for exerting a tension force on said at least one foil web on the other side of said press;

said control means further comprising means for controlling said foil feed device and said tensioning device such that said at least one foil web is kept stationary with a longitudinal web speed of zero in an embossing position on said embossing table during the entire duration of said embossing phase (TP) and such that said at least one foil web is longitudinally advanced to a next embossing position during said embossing free phase (TL), said web having a feed speed VV at said embossing location, an unwinding web speed V7 at said unwinding roll (7) and a web speed V8 at said foil removal device, wherein VV≠V7≠V8 during at least portions of said press cycle;

said control means controlling said at least one foil loop store to increase and decrease the size of said at least one loop in response to inequalities of said speeds to compensate for differences in said speeds and to permit movement of said at least one foil web.

16. An embossing machine according to claim 15 wherein said guide surface is formed so that surface of said guide surface contacted by said foil web is less than half of the surface area covered by said foil web as it passes said surface.

17. An embossing machine according to claim 16 wherein at least entry walls of said loop stores have a textured surface comprising a selected one of channels, fine mesh wire gauze, knobbed plate or corrugated plate.

18. An embossing machine according to claim 16 wherein an entry wall comprises injection openings (75), said loop store including air under pressure passing through said injection openings into said loop store.

19. An embossing machine according to claim 18 wherein said injection openings have a diameter of 0.5 to 1 mm and a mutual spacing of 5 to 20 cm.

20. An embossing machine according to claim 15 wherein said guide walls comprise electrically conductive surfaces, said machine comprises an adjustable voltage source connected to apply an electrical potential (U2) to an entry guide wall to create an electrically repelling force toward said foil web and thereby reduce frictional engagement with said wall.

21. An embossing machine according to claim 20 including a capacitive potential probe (95) for determining electrical potential (U1) of said foil web entering said loop store and for adjusting said electrical potential (U2) of said guide wall.

22. A flat embossing machine for embossing a flat material comprising the combination of a flat press (2) with an embossing table (3) and a tool plate (4);

control means for operating said press in a press cycle (TO) comprising alternately an embossing phase (TP) and an embossing-free phase (TL);

said flat press comprising a bent lever press and means for adjusting bent lever geometry of said press so that movement of said embossing table and said embossing phase are variable;

at least one elongated foil web (6) for conveying material to be embossed;

means for guiding said at least one foil web from an unwinding roll (7) across said embossing table to a foil removal device (8), at least one foil loop store (10) having a differential pressure device (30) for forming at least one foil loop (12) in said at least one foil web (6) by establishing an air pressure difference across said at least one foil web;

a foil feed device (24) on one side of said press and a tensioning device (25) for exerting a tension force on said at least one foil web on the other side of said press;

said control means further comprising means for controlling said foil feed device and said tensioning device such that said at least one foil web is kept stationary with a longitudinal web speed of zero in an embossing position on said embossing table during the entire duration of said embossing phase (TP) and such that said at least one foil web is longitudinally advanced to a next embossing position during said embossing free phase (TL), said web having a feed speed VV at said embossing location, an unwinding web speed V7 at said unwinding roll (7) and a web speed V8 at said foil removal device, wherein VV≠V7≠V8 during at least portions of said press cycle;

said control means controlling said at least one foil loop store to increase and decrease the size of said at least one loop in response to inequalities of said speeds to compensate for differences in said speeds and to permit movement of said at least one foil web.

23. An embossing machine according to claim 22 wherein said bent lever press includes levers having pivotable joints therein and wherein the bent lever geometry is adjustable by means varying spacing between bent lever joints of said levers.

24. An embossing machine according to claim 23 wherein said varying means includes controllable motors programmably controlled by said control means, said adjustment being timed to be accomplished stepwise during said embossing-free phase (TL) with said machine running.

25. An embossing machine according to claim 22 including a positioning device for adjusting a position of said tool plate through a print control having a control program and pressure sensors.

26. An embossing machine according to claim 22 including a conveying device for sheets of material to be embossed, said conveying device including a feeder, delivery means, sensors and a register draw-in device having a register control and sensor-controlled front and side stops for orienting sheets according to print marks detected by said sensors.

27. An embossing machine according to claim 22 including a conveying device for a continuous web of material to be embossed and sensors, said conveying device including a register control for orienting and controlling said web according to print marks detected by said sensors and a web edge control, said control acting to adjust said web transversely to a direction of web movement using said web edge control and to adjust speed of said web longitudinally by controlling said web feed.

* * * * *